US005688749A

United States Patent [19]

Ibuki et al.

[11] Patent Number: 5,688,749

[45] Date of Patent: Nov. 18, 1997

[54] ANIMAL AND VEGETABLE LUBRICATING OIL COMPOSITION

[75] Inventors: Masahisa Ibuki, Sennan-gun; Yoko Imamura, Izumisano; Eiko Furumoto, Matsubara; Tsugio Nishimoto, Naga-gun, all of Japan

[73] Assignee: Fuji Oil Company, Limited, Osaka-fu, Japan

[21] Appl. No.: 644,355

[22] Filed: May 10, 1996

[30] Foreign Application Priority Data

May 22, 1995 [JP] Japan ..... 7-122890

[51] Int. Cl.[6] ..... C10M 105/38

[52] U.S. Cl. ..... 508/486

[58] Field of Search ..... 508/459, 486

[56] References Cited

U.S. PATENT DOCUMENTS

| | | | |
|---|---|---|---|
| 2,225,552 | 12/1940 | Colbeth | 44/486 |
| 2,484,328 | 10/1949 | Agster | 44/486 |
| 3,507,791 | 4/1970 | Teeter et al. | 252/34.7 |
| 3,574,112 | 4/1971 | Nelson | 508/459 |
| 4,844,721 | 7/1989 | Cox et al. | 55/85 |
| 5,468,405 | 11/1995 | Klein et al. | 44/486 |

OTHER PUBLICATIONS

Database WPI, Section Ch, Week 9302, Derwent Publications Ltd., London, GB; Class H07, AN 93-011688, XP002022374, & JP-A-04 337 388 (Miyoshi Yushi KK), Nov. 25, 1992 *abstract*.

*Primary Examiner*—Margaret Medley
*Attorney, Agent, or Firm*—Wenderoth, Lind & Ponack

[57] ABSTRACT

There is disclosed an animal and vegetable lubricating oil composition which comprises a triglyceride, wherein the content of isolated trans isomers in component fatty acids of the triglyceride is 40% by weight to 100% by weight based on the whole weight of component fatty acids, and wherein the iodine value of the triglyceride is 50 to 90.

4 Claims, No Drawings

ANIMAL AND VEGETABLE LUBRICATING OIL COMPOSITION

FIELD OF THE INVENTION

The present invention relates to an animal and vegetable lubricating oil composition. More particularly, the present invention relates to an animal and vegetable lubricating oil composition having suitable melting point for workability and having a stable lubricating property.

BACKGROUND OF THE INVENTION

An animal and vegetable oil as a lubricating oil has hitherto been used for a direct mill rolling oil and the like. However, in most cases, a lubricating oil having a mineral oil as a main component has been used. This is because the animal and vegetable oil has the following problems: it has a lower oxidation stability in comparison with the mineral oil. As the animal and vegetable oil is deteriorated, sludge is produced and the viscous animal and vegetable oil adheres to the equipments and the like and, thereby, troublesome cleaning becomes necessary.

However, as interest in environmental problems recently grown worldwide lubricating oil having biodegradability has been desired. For example, in the case of those used for ships, the use of the lubricating oil having good biodegradability makes a contribution to the protection of the environment, in view of the leakage into the sea by some rare accident. In addition, since the lubricating oil, for chain saw and the like, used in the forest is liable to scatter into the soil, the lubricating oil having the biodegradability is inevitably desired.

In such background, as the lubricating oil having the biodegradability, a triglyceride oil such as an animal oil and a vegetable oil is suitable. However, since the animal oil has its unique offensive smell, it has been disliked. On the other hand, it is considered that the vegetable lubricating oil which has no such the offensive smell will be increasingly widely used in the future.

The animal and vegetable oil as a substitute for a mineral lubricating oil requires the following requirements: having a lower melting point, 2) having a higher viscosity at a working temperature, 3) having oxidation stability.

More particularly, 1) requires that the animal and vegetable oil be completely liquid around 25° C. in view of the working environment. Otherwise, the melting working of the lubricating oil is needed and the workability is lowered. 2) is required because when the viscosity is higher, the lubricating oil is difficult to be scattered and, therefore, the amount of the animal and vegetable oil to be used can be decreased. 3) is required because the oxidation stability is related to the duration of the lubricating property and the stability during the storage.

As regards these requirements, several proposals have been made. However, all of them do not satisfy the above three requirements. For example, JP-A 4-103694 discloses a chain saw lubricating oil wherein a wax and a animal and vegetable hardened oil are added to an unpurified animal and vegetable oil having the iodine value of 80 to 140. In the chain saw lubricating oil, the viscosity in the working region is improved by adding the animal and vegetable hardened oil to the liquid oil and, as the result, a good lubricating property is observed indeed. However, there still remains the problem that the melting point rises by adding the wax and the hardened oil and the oxidation stability is not good.

The lubricating oil for a food manufacturing machine is directly contacted with a food. Therefore, the use of the animal and vegetable oil has been previously proposed. For example, JP-A 5-320678 and JP-A 4-314794 disclose a lubricating oil for a food manufacturing machine utilizing a middle chain length fatty acid glyceride. The lubricating oil has good oxidation stability and the melting point can be lowered, which results in good workability. However, it has such drawback that the viscosity is lowered.

OBJECTS OF THE INVENTION

A main object of the invention is to provide an animal and vegetable lubricating oil composition having a lower melting point for good workability as well as the higher viscosity and higher oxidation stability.

This object as well as other objects and advantages of the present invention will become apparent to those skilled in the art from the following description.

SUMMARY OF THE INVENTION

The present inventors studied hard to solve the above problems and, as the result, found that a triglyceride having a specified range of iodine value and a specified range of the amount of isolated trans acids present in its component fatty acids has a lower melting point, higher viscosity and higher stability, which resulted in completion of the present invention.

That is, the present invention provides an animal and vegetable lubricating oil composition which comprises a triglyceride, wherein the content of isolated trans isomers in component fatty acids of the triglyceride is 40% by weight to 100% by weight based on the whole weight of component fatty acids, and wherein the iodine value of the triglyceride is 50 to 90.

DETAILED DESCRIPTION OF THE INVENTION

The animal and vegetable oil composition of the present invention can be prepared starting from an animal and vegetable fat or oil. Examples of the vegetable fat or oil are palm oil, palm kernel oil, rape seed oil, soy bean oil, safflower oil, sunflower oil, rice bran oil, cotton seed oil and the like. Examples of the animal fat or oil are tallow, lard, milk fat, fish oil, whale oil and the like. As described above, the vegetable oil is preferable in the respect that it has no unique offensive smell.

The lubricating oil refers to the lubricating agent having the function such as decrease in friction between frictioning surfaces, decrease in wear, decrease in frictional heat and prevention of baking. Examples thereof are chain saw oil, engine oil, cutting oil, machine oil, hydraulic oil, gear oil, turbine oil, compressor oil, refrigerating oil, rust preventing oil and the like.

The isolated trans isomer in the present invention refers to a non-conjugated trans-type unsaturated fatty acid. All double bonds in the unsaturated fatty acid do not necessarily need to be trans and one or more double bonds may be non-conjugated trans-type. However, according to the findings by the present inventors, trans-type is more excellent in the stability than cis-type even in the case of unsaturated fatty acid having many double bonds.

Examples of the isolated trans isomer are those where one or more double bonds in the unsaturated fatty acid such as palmitoleic acid, oleic acid, vaccenic acid, linoleic acid, linolenic acid, eleostearic acid, eicosaenoic acid and the like are non-conjugated trans-type.

The present animal and vegetable oil composition preferably contains trans-typed double bonds of palmitole acid, oleic acid, vaccenic acid and linoleic acid.

These trans isomers can be determined by STANDARD FAT OR OIL ANALYSIS METHOD 2. 4. 24. 2–81 and isolated trans isomers in the component fatty acids are calculated in terms of the content of elaidic acid.

In the present animal and vegetable lubricating oil composition, the content of isolated trans isomers in component fatty acids of the triglyceride is 40% by weight to 100% by weight, preferably 50% by weight to 100% by weight based on the whole weight of the component fatty acids. When the content is less than 40% by weight, the oxidation stability and the viscosity are decreased. Even when component fatty acids are all isolated trans isomers, that is, the content of the isolated trans isomers is 100% by weight, the advantages of the present invention is not adversely influenced.

The iodine value of the triglyceride in the present invention is 50 to 90, preferably 60 to 80. When the iodine value is less than 50, good workability is not attained from a viewpoint of the melting point. On the other hand, when the iodine value exceeds 80, there is a problem with the oxidation stability.

The animal and vegetable lubricating oil composition having the aforementioned components can be prepared according to the conventional method. For example, an animal and vegetable oil is isomerization-hardened using a catalyst poisoned with methionine or sulphur, a nickel catalyst, a copper catalyst, particularly, a waste catalyst and the like, the resultant hardened animal and vegetable oil is dissolved in an organic solvent such as hexane, acetone or the like, and the low melting point fraction is fractionated (so-called solvent fractionating method), or the low melting point fraction is fractionated by pressurizing or cooling the isomerization-hardened animal and vegetable oil without using the organic solvent (so-called dry fractionating method).

The fat or oil, in the present invention, having the isolated trans isomers thus obtained is sterically more difficult to undergo the attack of oxygen, therefore, oxidation, than that having the cis isomers. Accordingly, better oxidation stability is attained. Furthermore, the animal and vegetable oil composition having the trans isomers has higher viscosity than that having the cis isomers. The present inventors deduce that this is due to the fact that the trans isomers are in the more rigid state than the cis isomers from a viewpoint of the molecular structure. Further, the low melting property leads to a problem when the iodine value is low. However, since the present invention has the suitable low melting property, the workability is good regardless of the iodine value.

The animal and vegetable oil composition of the present invention may be used in an admixture with other lubricating oils such as a mineral lubricating oil and a synthetic lubricating oil. Various additives may be incorporated therein. Examples of the additives are surfactants such as fatty acid, esters, dimer acid, phosphate extreme pressure additive.

The following Examples and Comparative Examples illustrate the present invention in detail but are not to be construed to limit the scope thereof.

EXAMPLES 1 TO 3 AND COMPARATIVE EXAMPLE 1

Palm Superolein (iodine value; 68) was isomerization-hardened using a catalyst poisoned with methionine to obtain hardened Palm Superolein (iodine value; 55). This was dissolved in hexane, the high melting point fraction was removed by fractionation to obtain a vegetable lubricating oil composition (t). Similarly, a soy bean oil (iodine value; 103) was isomerization-hardened using a catalyst poisoned with methionine to obtain a hardened soy bean oil (iodine value; 72), the high melting point fraction was removed using hexane to obtain a vegetable lubricating oil composition (2). Furthermore, a rice bran oil (iodine value; 103) was isomerization-hardened, and the acetone-fractionation was carried out according to the similar procedures to obtain a vegetable lubricating oil composition (3).

As Comparative Example 1, Palm Superolein (iodine value; 68) was normally hardened using a nickel catalyst to obtain a hardened oil having a small amount of the isolated trans isomers, which was acetone-fractionated according to the same manner as that described for the vegetable lubricating oil composition (1) to obtain .a vegetable lubricating oil composition (4). The test of the physical properties was carried out using these vegetable lubricating oil compositions.

Measurement of friction coefficient

Friction coefficient was measured using the following measuring machine.

Friction measuring machine; pin-block friction testing machine

Pin material; AISI/SA-E 3135 STEEL

Block material; VEEBLOCK AISI1137 STEEL

Method for measuring oxidation stability of lubricating oil composition

Measurement was carried out by a method according to STANDARD FAT OR OIL ANALYSIS 2.4. 28. 1–81AOM test.

Kinematic viscosity

The kinematic viscosity was measured using a Canon Feske viscometer at 35° C. 50° C. and 100° C.

The results are shown in Table 1.

TABLE 1

| | Example | | | |
|---|---|---|---|---|
| | 1 | 2 | 3 | Comp. Ex. |
| Vegetable lubricating oil composition | (1) | (2) | (3) | (4) |
| Iodine value | 66.5 | 83.1 | 75.6 | 66.9 |
| Isolated trans isomers content (%) | 50.5 | 85.0 | 58.2 | 13.0 |
| Softening point (°C.) | 17.9 | 15.8 | 15.2 | 16.3 |
| Friction coefficient | 0.0496 | 0.0472 | 0.0465 | 0.0482 |
| Kinematic viscosity (CST) | | | | |
| 35° C. | 115.8 | 128.0 | 119.3 | 102.6 |
| 50° C. | 45.8 | 47.8 | 46.0 | 35.6 |
| 100° C. | 17.8 | 19.0 | 18.0 | 10.3 |
| Oxidation stability | 350 | 420 | 360 | 120 |

As seen from the above results, the present lubricating oil composition has not a the melting point of not higher than 20° C. suitable for the good workability but also higher viscosity and higher stability. Furthermore, the present lubricating oil composition has extremely good value of friction coefficient which manifests the lubricating property. Therefore, the present invention can provide a good vegetable lubricating oil composition.

COMPARATIVE EXAMPLES 2 TO 4

A soy bean oil (iodine value; 120) was isomerization-hardened using a catalyst poisoned with methionine to obtain a soy bean oil (iodine value; 72). This was dissolved in hexane to fractionate, the resulting low melting point fraction was dissolved in acetone to fractionate again to recover the low melting point fraction, to obtain a vegetable lubricating oil composition (5). A rice bran oil (iodine value; 103) was isomerization-hardened, the acetone-fractionation was carried out to recover the low melting point fraction to obtain a vegetable lubricating oil composition (6). Palm Superolein (iodine value; 68) was isomerization-hardened using a catalyst poisoned with methionine to obtain a vegetable lubricating oil composition (7). The test of the physical properties was carried out using these lubricating oil compositions as in Examples 1 to 3. The results are shown in Table 2.

TABLE 2

| | Comparative Example | | |
|---|---|---|---|
| | 2 | 3 | 4 |
| Vegetable lubricating oil composition | (5) | (6) | (7) |
| Iodine value | 105.6 | 98.6 | 45.2 |
| Isolated trans isomers content (%) | 62.0 | 71.0 | 47.0 |
| Softening point (°C.) | 3.0 | 2.3 | 37.5 |
| Friction coefficient | 0.0523 | 0.0568 | 0.0423 |
| Kinematic viscosity (CST) | | | |
| 35° C. | 117.2 | 131.2 | Unmeasurable (note) |
| 50° C. | 47.0 | 48.5 | 42.0 |
| 100° C. | 17.1 | 19.0 | 13.6 |
| Oxidation stability | 118 | 125 | 310 |

Note; unmeasurable because of too much fat or oil crystals

As seen from the above results, the lubricating oil composition having the isolated trans isomers content of not less than 40% show the viscosity necessary as a lubricating oil. However, when the iodine value exceeds 90, the oxidation stability is remarkably deteriorated. When the iodine value is below 50, the oxidation stability is good but the melting point is remarkably uncreased, showing no good workability. Thus, the lubricating compositions defined by the present invention have good oxidation stability, the viscosity necessary as a lubricating oil and a low melting point suitable for good workability.

What is claimed is:

1. An animal or vegetable lubricating oil composition which comprises a triglyceride, wherein the content of isolated trans isomers in component fatty acids of the triglyceride is 40% by weight to 100% by weight based on the whole weight of component fatty acids, and wherein the iodine value of the triglyceride is 50 to 90.

2. The composition according to claim 1, wherein the content of the isolated trans isomers is 50% by weight to 100% by weight.

3. The composition according to claim 1, wherein the iodine value of the triglyceride is 60 to 80.

4. The composition according to claim 1, wherein the isolated trans isomers are derived from one of more of palmitoleic acid, oleic acid, vaccenic acid and linoleic acid.

* * * * *